US006116858A

United States Patent [19]

Narabayashi

[11] Patent Number: 6,116,858

[45] Date of Patent: Sep. 12, 2000

[54] JET FINISHING MACHINE, JET FINISHING SYSTEM USING TWO-PHASE JET FINISHING METHOD

[75] Inventor: Tadashi Narabayashi, Yokohama, Japan

[73] Assignee: Kabushiki Kaisha Toshiba, Kawasaki, Japan

[21] Appl. No.: 08/927,267

[22] Filed: Sep. 11, 1997

[30] Foreign Application Priority Data

Sep. 12, 1996 [JP] Japan ..... 8-263519

[51] Int. Cl.[7] ..... F04F 19/24

[52] U.S. Cl. ..... 417/54; 417/197; 134/31; 134/167 R; 134/170

[58] Field of Search ..... 417/59, 151, 197

[56] References Cited

U.S. PATENT DOCUMENTS

| | | | |
|---|---|---|---|
| 126,525 | 5/1872 | Cox | 417/197 |
| 1,137,767 | 5/1915 | Leblanc | 417/182 |
| 4,164,325 | 8/1979 | Watson . | |
| 4,569,635 | 2/1986 | Nicodemus | 417/196 |
| 4,673,335 | 6/1987 | Nicodemus . | |
| 4,725,201 | 2/1988 | Nicodemus . | |
| 4,781,537 | 11/1988 | Nicodemus . | |
| 4,806,277 | 2/1989 | Sakurai et al. . | |
| 4,847,043 | 7/1989 | Gluntz | 376/372 |
| 4,931,225 | 6/1990 | Cheng | 261/76 |

FOREIGN PATENT DOCUMENTS

| | | |
|---|---|---|
| 0 514 914 | 11/1992 | European Pat. Off. . |
| 0 607 974 | 7/1994 | European Pat. Off. . |
| 0 711 926 | 5/1996 | European Pat. Off. . |

OTHER PUBLICATIONS

Patent Abstracts of Japan, vol. 96, No. 11, Nov. 29, 1996, JP 08 192079, Jul. 30, 1996.

Patent Abstracts of Japan, vol. 18, No. 272 (M–1610), May 24, 1994, JP 06 047670, Feb. 22, 1994.

*Primary Examiner*—Charles G. Freay
*Assistant Examiner*—Ehud Gartenberg
*Attorney, Agent, or Firm*—Oblon, Spivak, McClelland, Maier & Neustadt, P.C.

[57] ABSTRACT

A jet finishing machine comprises: a water nozzle (1) for spouting a water jet flow of water in a liquid phase; a steam nozzle (3) for increasing the speed of a steam flow (4) in a gas phase to an ultrasonic speed to produce a steam jet flow (11) and for spouting the steam jet flow in excess of a thermal equilibrium with the water jet flow; and a mixing nozzle (2) for mixing the steam jet flow with the water jet flow so as to allow the steam jet flow to accelerate the water jet flow to form a two-phase jet flow (12) of the water jet flow and the steam jet flow and for directly spouting the two-phase jet flow onto a work piece (5).

13 Claims, 11 Drawing Sheets

CAVITATION / EROSION → FINISHING FOR FIVE MINUTES

B2 (MIG WELDING, GRINDER FINISHING)

100 μm

B2-① (MIG WELDING, GRINDER FINISHING + SI JET 2.5H)

100 μm

JET FINISHING MACHINE, JET FINISHING SYSTEM USING TWO-PHASE JET FINISHING METHOD

BACKGROUND OF THE INVENTION

1. Field of the Invention

The present invention relates generally to a jet finishing machine, a jet finishing system using two-phase jet finishing method. More specifically, the invention relates to a jet finishing and polishing machine which is used for the removal of deposits on a metal surface in a finish machining step and/or a surface washing step of a machining and for the removal of burrs in a machining generally carried out in manufacturing industries, such as automobile, electrical, semiconductor and atomic industries and aerospace and aircraft work, and which can improve surface stress, a jet finishing system using the jet finishing machine, and a jet finishing method for use in the jet finishing machine.

2. Description of the Prior Art

When a finishing machine such as turning, drilling or milling machine, or a surface finishing machine such as grinding, grinder finishing or buffing machine is used, machining flutes may remain in the finished surface to cause wear and abnormal discharge in a precision instrument part, an electrical part or the like, so that it is required to remove such machining flutes and so forth. On the other hand, when electrochemical means such as electrolytic polishing is used, a great deal of electrolyte such as acid and alkali must be used. Therefore, there is a problem in environmental protection and there is another problem in that the electrochemical means is unsuitable for the finishing of articles in mass production since it takes a lot of time.

In recent years, a jet washer or water jet cleaning system using a jet of high-pressure water has been utilized. However, since the jet washer uses a high-pressure water of 300 atm. (30 MPa) to 3,000 atm. (300 MPa), it is required to provide a special high pressure pump and a special power source and to carry out inspection and maintenance services.

Therefore, a new type of steam injectors have been developed in the field of cleaning by Carl Nicodemus in USA. An example thereof is disclosed in U.S. Pat. No. 4,781,537 entitled "Variable Flow Rate System for Hydrodynamic Amplifier".

As shown in FIG. 10, this steam injector comprises a water nozzle 101, a mixing nozzle 102 and a diffuser 112. Such a steam injector is called a pressure amplifier condenser (PAC). A high-pressure hot water feeder, a water discharging flexible hose 114 and a water gun 115 are mainly mounted on the steam injector to be widely used as a jet cleaning.

The velocity energy of a high-speed water jet flow accelerated in the mixing nozzle 102 is converted into a high discharge pressure while it flows through the diffuser 112. The hot water jet flow having the high discharge pressure is introduced into the water gun 115 by means of the water discharging flexible hose 114, and converted into a high-speed water jet flow 116 having a large velocity energy again to be impinged onto a work piece 105.

In the steam injector shown in FIG. 10, steam is supplied from a steam nozzle 103 to the mixing nozzle 102 so as to have a thermal equilibrium with the water supplied from the water nozzle 101 to the mixing nozzle 102. That is, in a mixing nozzle 102, all the steam supplied from the steam nozzle 103 to the mixing nozzle 102 is mixed with the water supplied from the water nozzle 101, so as to control the temperature, flow rate and so forth of the system to make a single phase water.

An example of a surface reforming of metallic materials using a high-speed two-phase jet flow is described in Japanese Patent Laid-Open No. 6-47670.

As mentioned above, in the steam injector shown in FIG. 10, the jet flow spouted from the mixing nozzle 102 is a single-phase jet water, and the finishing technique is quite different from that in the surface finishing utilizing a cavitation phenomenon such as that in the present invention using a two-phase jet mixture of water and steam.

In addition, in the steam injector shown in FIG. 10, the jet flow discharged from the mixing nozzle 102 is input to the diffuser 112. Therefore, even if the jet flow discharged from the mixing nozzle 102 is formed as a two-phase jet, the cavitation phenomenon occurs in the diffuser 112, so that the cavitation phenomenon can not be caused by impinging the two-phase jet onto the work piece 105. In addition, since cavitation occurs in the diffuser 112, there is a problem in that the wall surface of the diffuser 112 is broken by the cavitation.

Moreover, in the steam injector shown in FIG. 10, the velocity energy is converted into the discharge pressure by means of the diffuser 112, and the jet flow of the high discharge pressure is converted into the high-speed jet flow in the water gun 115, i.e., the two conversions are carried out between the velocity energy and the discharge pressure, so that there is a problem in that the finishing pressure based on the jet flow is lowered.

In the case of Japanese Patent Laid-Open No. 6-47670, although air flow blows into a liquid jet flow, the air flow is not accelerated to have a very high speed to be spouted, so that it is difficult to accelerate the liquid jet flow. In addition, if the air flow is tried to be accelerated, it is required to increase the pressure thereof to a very high pressure, so that the system is complicated.

SUMMARY OF THE INVENTION

It is therefore an object of the present invention to eliminate the aforementioned problems and to provide a jet finishing machine, a jet finishing system and a jet finishing method, which have simple constructions and which can effectively remove deposits on a finished surface and improve the deburring in metal working and the stress applied to a metal surface.

In order to accomplish the aforementioned and other objects, according to one aspect of the present invention, a jet finishing machine comprises: a water nozzle portion for spouting a water jet flow of water in a liquid phase; a steam nozzle portion for increasing the speed of a steam flow in a gas phase to a supersonic speed to produce a annulus steam jet flow and for spouting the steam jet flow in excess flow rate of a thermal equilibrium with the water jet flow; and a mixing nozzle portion for mixing the steam jet flow with the water jet flow to accelerate the water jet flow and to form a two-phase jet flow and for directly spouting the two-phase jet flow onto a work piece. The device does not need the diffuser.

In this jet finishing machine, the flow passage area in a minimum cross section nozzle taken along phanes perpendicular to the axis of said water nozzle portion and said steam nozzle position is set to be greater than a value which is set so as to form a thermal equilibrium between the steam jet flow and the water jet flow. The flow rate of water supplied to the water nozzle portion may be greater than a flow rate of water which is set so as to form a thermal equilibrium between the steam jet flow and the water jet flow. The steam jet flow may be mixed with the water jet flow in the mixing nozzle so that the steam jet flow is condensed and penetrates the water jet flow in the form of a plurality of small bubbles. The tip portion of the mixing nozzle portion may be formed with a nozzle port parallel to an axial direction of the mixing nozzle portion, like the mechanism shown in the patent by Carl Nicodemus. The water and the steam flow may be produced from pure water.

According another aspect of the present invention, a jet finishing method comprises the steps of: spouting a water jet flow of water in a liquid phase; increasing the speed of a steam flow in a gas phase to an supersonic speed so as to produce and spout a steam jet flow in excess flowrate of a thermal equilibrium with the water jet flow; mixing the steam jet flow with the water jet flow so as to allow the steam jet flow to accelerate the water jet flow to form a two-phase jet flow of the water jet flow and the steam jet flow; and directly impinging the two-phase jet flow onto a work piece.

According to the present invention, a water jet flow is spouted from a water nozzle, and the speed of a steam flow in a gas phase is increased to a supersonic speed so as to produce a high-speed steam jet flow, which is spouted from a steam nozzle in excess flow rate of a thermal equilibrium with the water jet flow. The water jet flow and the steam jet flow are mixed with each other in a mixing nozzle to allow the high-speed steam jet to accelerate the water jet flow so as to produce a two-phase jet flow of the water jet flow and the steam jet flow, so that the two-phase jet flow is spouted from the mixing nozzle. Since the steam jet flow is mixed with the water jet flow in excess of the thermal equilibrium with the water jet flow, a plurality of small bubbles are formed in the two-phase jet flow. Throughout the specification, the expression "mixing in excess of the thermal equilibrium" means that "mixing in excess of the thermal equilibrium when a saturated water is produced at an outlet of the mixing nozzle (a nozzle port)". This two-phase jet flow is impinging onto a work piece, so that steam bubbles mixed in the water jet flow disappear on the surface of the work piece to cause a cavitation/erosion phenomenon to finish the surface of the work piece.

According to the present invention, since the two-phase jet flow is formed by the water in the liquid phase and the steam in the gas phase, the steam is easy to be condensed into the water to increase the speed of the steam to a supersonic speed, so that it is possible to easily accelerate the water jet flow by the steam jet flow. Therefore, for example, unlike a two-phase jet flow formed by water in a liquid phase and air or the like in a gas phase, it is possible to accelerate the water jet flow without increasing the pressure of a supplied steam flow, and it is possible to simplify the structure of the system.

According to the present invention, it is possible to effectively remove deposits adhered to the surface of a work piece and/or burrs or the like in metal working, and it is also possible to effectively improve the stress on a metal surface. In addition, it is possible to effectively deposits on a metal surface and/or burrs in machining and to improve the surface stress, using a liquid of a lower pressure than those of conventional systems and without the need of any mechanical means, such as a grinder finishing machine or a buffing machine, and any electrochemical means, such as an electrolytic polishing machine. Since the discharge pressure of conventional steam injectors is in the range of from 5 MPa to 10 MPa, it is difficult to obtain a higher discharge pressure than 30 MPa required for a jet finishing machine. The present invention can also eliminate this problem.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, the preferred embodiments of a jet finishing machine, a jet finishing method and a jet finishing system, according to the present invention, will be described below.

Figure 1:
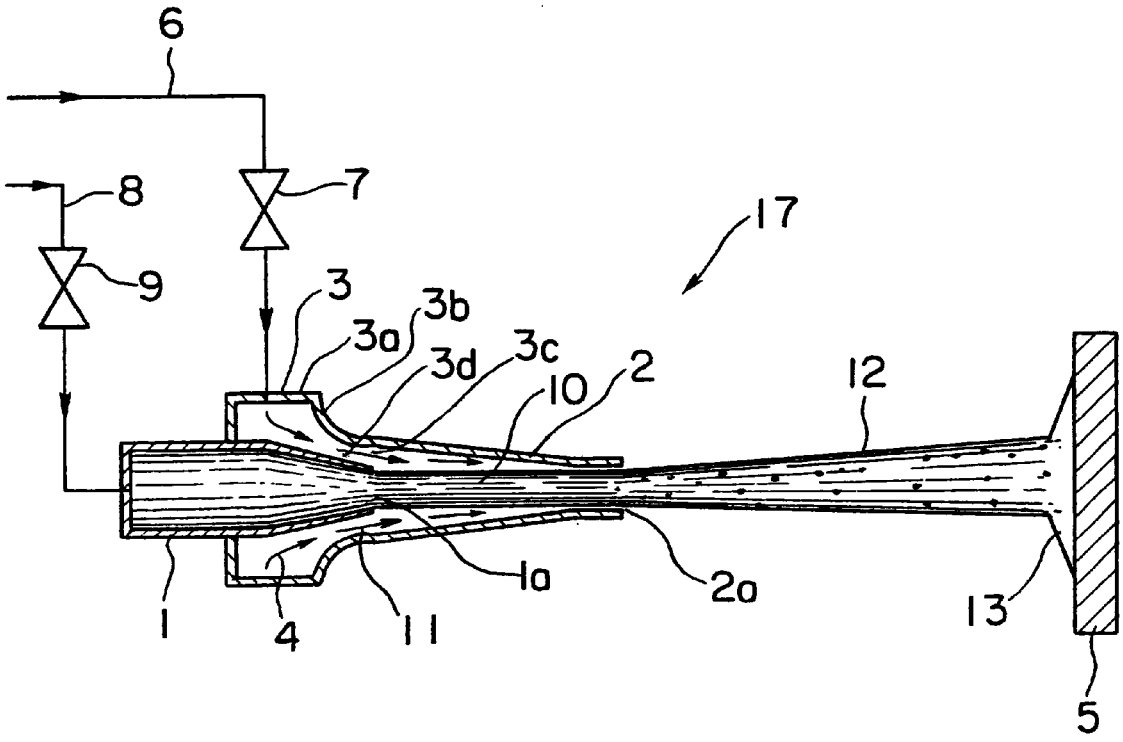
FIG. 1 is a schematic cross-sectional view illustrating a basic construction of a jet finishing machine according to the present invention.

FIG. 1 is a schematic view illustrating a basic construction of a jet type steam injector of a jet finishing machine according to the present invention. In FIG. 1, reference number 1 denotes a water nozzle for spouting a jet of water in a liquid phase. The water nozzle 1 is formed so that a conical portion tapered toward the tip thereof is connected a cylindrical portion. Water is supplied from the bottom of the cylindrical portion of the water nozzle via a water supply pipe 8 and a water supply valve 9, so that a water jet flow 10 is cylindrically spouted from a nozzle port la at the tip of the conical portion.

A steam nozzle 3 is fitted into the outer peripheries of the cylindrical and conical portions of the water nozzle 1 so as to be concentric with the water nozzle 1. The steam nozzle 3 has a cylindrical portion 3*a* and a curved portion 3*b* located downstream of the cylindrical portion 3*a*. The curved portion 3*b* has an inwardly recessed shape. A nozzle port 3*c* of the steam nozzle 3 is located substantially outside of the nozzle port 1*a* of the water nozzle 1. The cross sections taken along planes perpendicular to the axes of the water nozzle 1 and the steam nozzle 3 are annular cross sections. The annular cross sections include a minimum cross-sectional portion 3*d* upstream of the nozzle port 3*c*. The area of the minimum cross-sectional portion 3*d* is set to be greater than the value which is set so as to form a thermal equilibrium between a steam jet flow and the water jet flow. The water nozzle 1 is provided on the steam nozzle 3 so as to be movable in longitudinal directions, so that the area of the minimum cross-sectional portion 3*d* can be changed by moving the water nozzle 1 in the longitudinal directions.

A steam flow 4 in a vapor phase is supplied to the steam nozzle 3 via a steam supply pipe 6 and a steam supply valve 7. When the steam flow 4 passes through the minimum cross-sectional portion 3*d*, the steam flow 4 is accelerated to a supersonic speed to form an accelerated steam jet flow (a supersonic flow) 11.

A mixing nozzle 2 is connected to the nozzle port 3*c* at the tip of the steam nozzle 3. The mixing nozzle 2 has a tapered conical shape. At the tip of the mixing nozzle 2, a nozzle port 2*a* is formed so as to extend in the longitudinal directions. Since the supersonic flow 11 is supplied in excess of the thermal equilibrium with the water jet flow 10, the supersonic flow 11 is introduced from the outer periphery of the cylindrical water jet flow 10 into the mixing nozzle 2, so that a two-phase flow comprising the water jet flow 10 and the supersonic flow 11 of steam is formed to be spouted as a high-speed two-phase jet flow 11 from the nozzle port 2*a* of the mixing nozzle 2. In the mixing nozzle 2, the steam jet flow 11 is condensed into the water jet flow 10 and penetrates the water jet flow 10 in the form of a plurality of small bubbles to be mixed therein. The water jet flow 10 has a flow velocity of, e.g., about 10 m/sec, and the supersonic flow 11 has a flow velocity of, e.g., about 500 m/sec. The high-speed two-phase flow 12 is directly spouted, as a free jet flow, from the nozzle port 2*a* onto the work piece 5 spaced from the nozzle port 2*a* at an interval, so as to form a collision jet flow 13 on the surface of the work piece 5. The water and steam are produced from pure water.

The steam is supplied to the steam nozzle 3 via the steam supply pipe 6 and the steam supply valve 7 so that an excess of the steam is mixed with the water jet flow 10 in the mixing nozzle 2 in excess of the thermal equilibrium. Therefore, the steam supply valve 7 is controlled so as to be open widely so that a greater amount of steam jet flow is supplied to the steam nozzle 3 than when the steam jet flow is supplied so as to form the thermal equilibrium with the water jet flow 10.

Thus, the high-speed two-phase jet flow 12 spouted from the nozzle port 2*a* of the mixing nozzle 2 moves through a space to the work piece 5 as a free jet flow, and then, it becomes the collision jet flow 13 on the surface of the work piece 5. Within this collision jet flow 13, a high pressure is applied to the surface of the work piece, so that the steam bubbles in the collision jet flow 13 disappears to cause a cavitation phenomenon. Since this cavitation phenomenon occurs on the surface of the work piece 5 such as a metal plate, it causes erosion. The surface of the work piece is trimmed by the cavitation/erosion.

Figure 10:
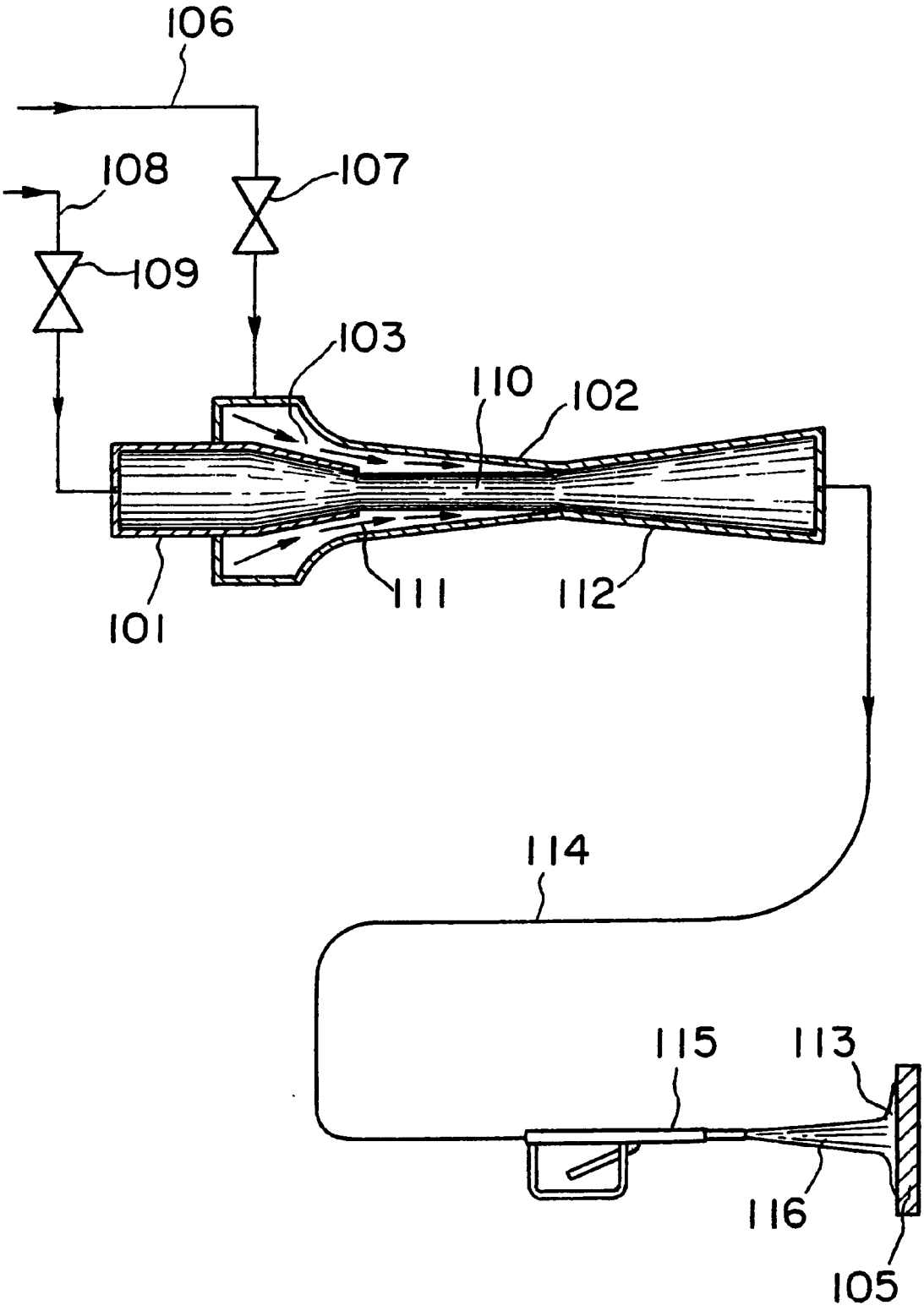
FIG. 10 PRIOR ART
FIG. 10 is a schematic view of a conventional steam injector.

Unlike the case shown in FIG. 10, the nozzle port 2*a* is formed at a free end of the mixing nozzle 2, and no diffuser is connected thereto. Therefore, when the high-speed two-phase jet flow 12 is spouted onto the work piece, it is possible to effectively cause cavitation and erosion. In addition, if a diffuser is provided, it is possible to prevent the inner wall of the diffuser from being destroyed due to the cavitation and so forth which may be produced therein.

In addition, unlike the case shown in FIG. 10, it is not required to carry out two conversion steps such as the conversion steps from the velocity energy to the discharge pressure by means of the diffuser 112 and from the jet flow of the high discharge pressure to the high speed jet flow in the squirt gun 115, and the high-speed two-phase jet flow is directly spouted onto the work piece as a free jet flow. Therefore, it is possible to prevent the energy conversion loss in the conversion between the velocity energy and the discharge pressure.

Figure 2:
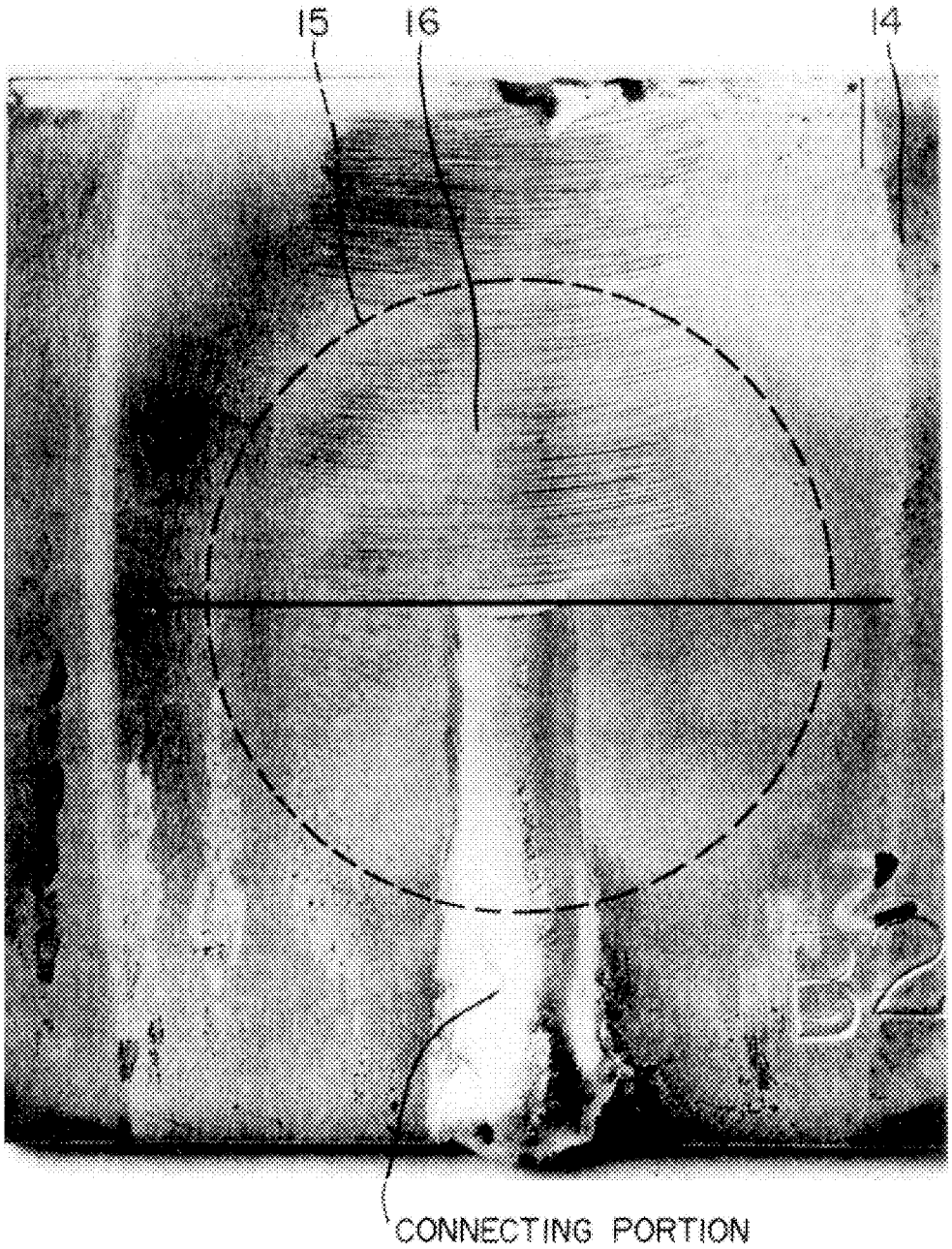
FIG. 2 is a photograph showing a grinder finished surface in a metal surface of an aluminum test piece and a place in which cavitation and/or erosion occurs.
Figure 11:
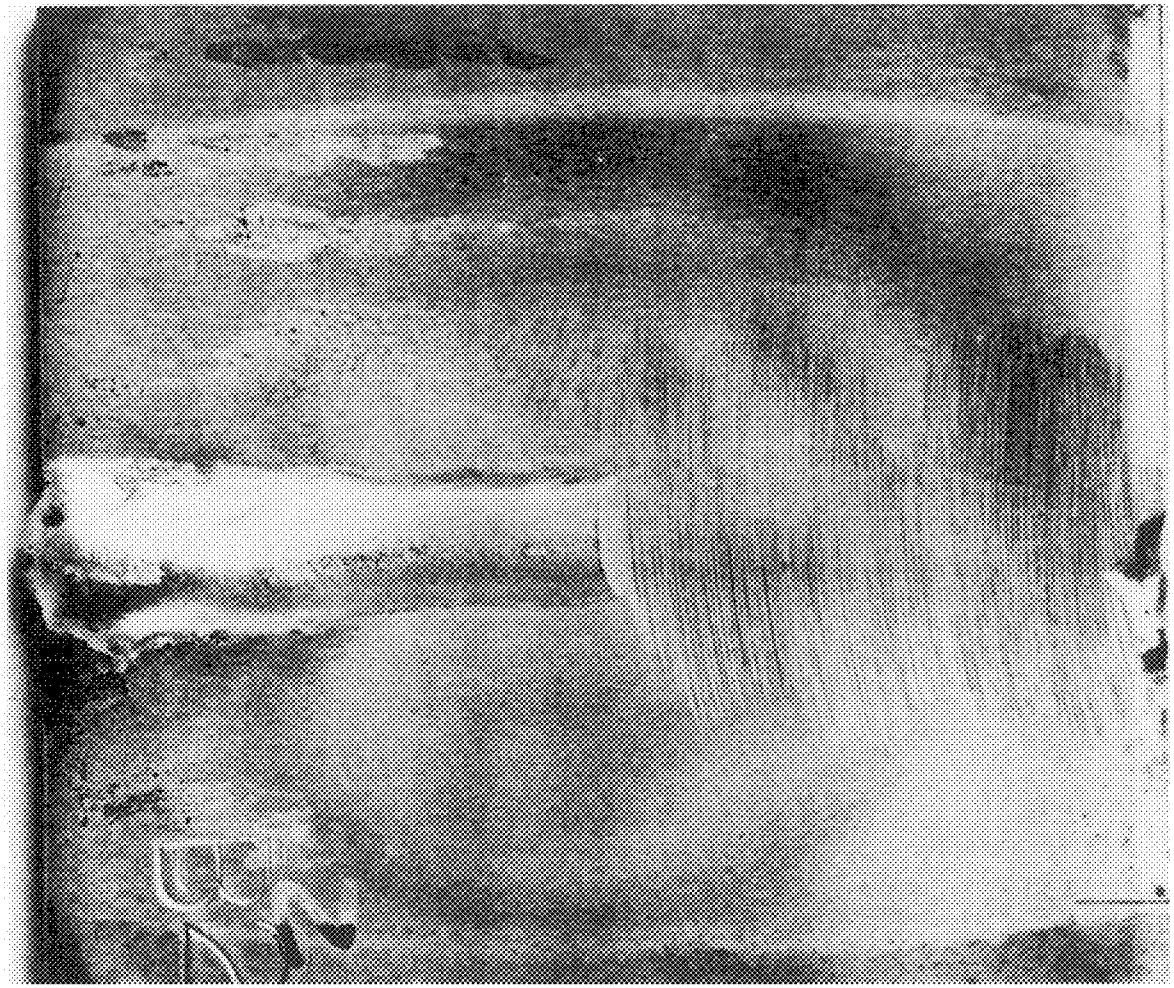
FIG. 11 is a photograph showing the state of a metal surface obtained by spouting a high-speed two-phase jet flow onto a part of an aluminum test piece in which a half of a weld has been grinder finished.

FIG. 11 is a photograph showing a metal surface obtained by spouting a high-speed two-phase jet flow 12 onto a part of an aluminum test piece 14 in which a half of a weld has been grinder finished. FIG. 2 is a photograph showing a part of the metal surface shown in FIG. 11. As shown in FIG. 2, there is an elevated weld, and the collision jet flow 13 is formed within a dotted circular line 15 around the upper end portion of the weld. This range is a cavitation/erosion occurring range. In FIG. 11, it is possible to recognize a silver cavitation/erosion occurring region 15 with the naked eye.

In addition, in the upper semi-circular portion defined by the dotted circular line 15 in FIG. 2, a grinder finished surface 16 is formed so that it can be recognized with the naked eye. Within the dotted circular line 15 containing the grinder finished surface 16, the high-speed two-phase jet flow 12 is spouted.

Figure 12:
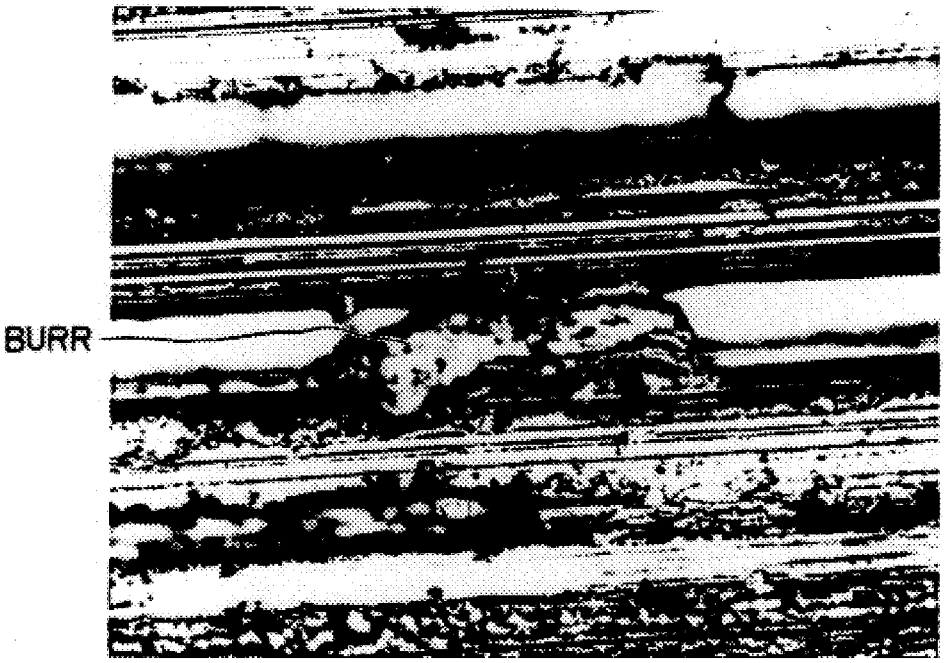
FIG. 12 is a microphotograph showing the state of a metal surface before a high-speed two-phase jet flow is spouted onto a part of an aluminum test piece in which a half of a weld has been grinder finished.
Figure 13:
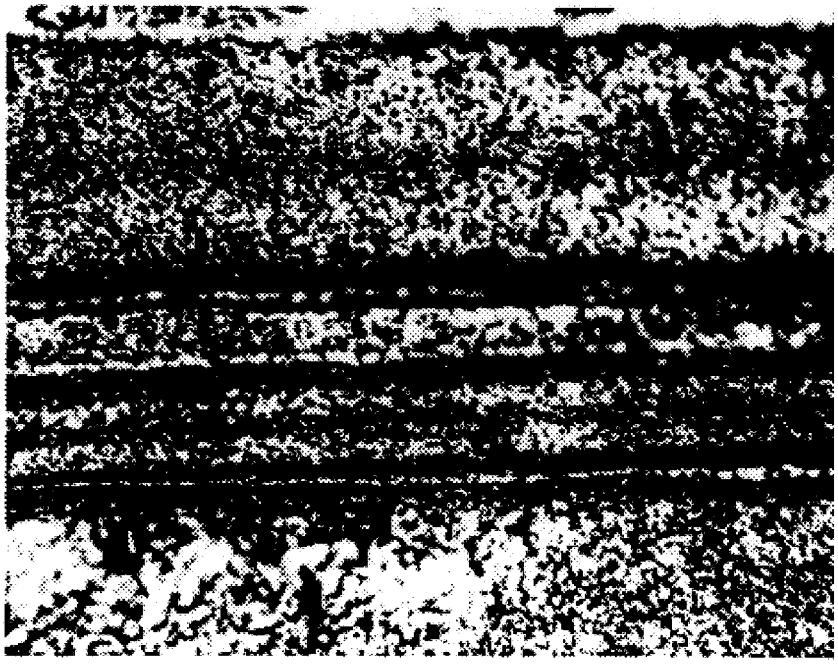
FIG. 13 is a microphotograph showing the state of a metal surface after a high-speed two-phase jet flow is spouted onto a part of an aluminum test piece in which a half of a weld has been grinder finished.

FIG. 12 is a microphotograph showing the state of the metal surface before the high-speed two-phase jet flow 12 is spouted onto the grinder finished surface 16 shown in FIG. 2 or 11, and FIG. 13 is a microphotograph showing the state of the metal surface after the high-speed two-phase jet flow 12 is spouted thereto. As shown in FIG. 12, a large number of burrs are observed along the finished flutes of the grinder finished surface 16 before the high-speed two-phase jet flow 12 is spouted. On the other hand, as shown in FIG. 13, a large number of cavitation pits (fine holes) are formed in the surface after the high-speed two-phase jet flow 12 is spouted, so that it can be seen that the burrs have been completely removed.

Figure 14:
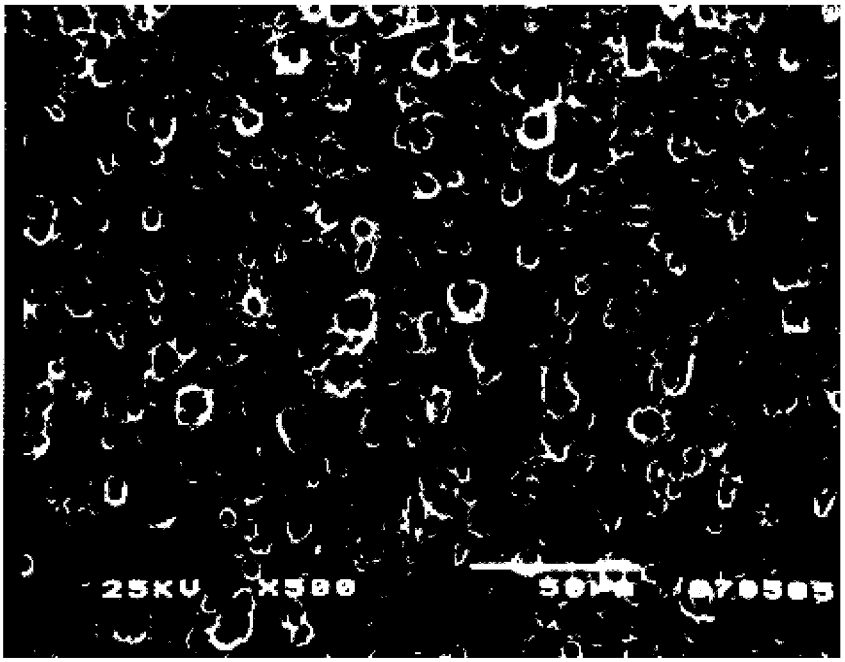
FIG. 14 is a microphotograph in which cavitation pits shown in FIG. 13 are enlarged by means of a scanning electron microscope.
Figure 15:
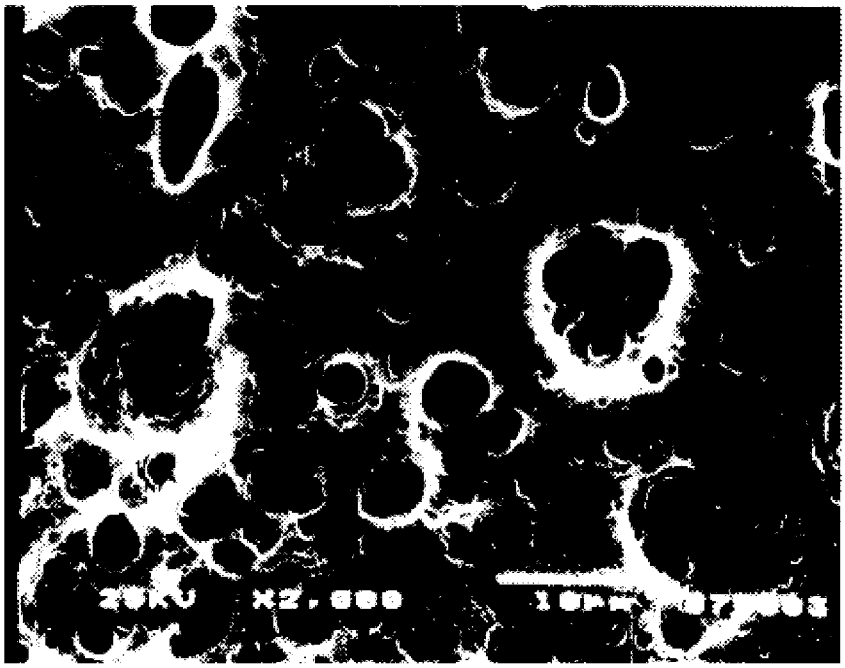
FIG. 15 is a microphotograph in which cavitation pits shown in FIG. 13 are enlarged by means of a scanning electron microscope.

FIGS. 14 and 15 are microphotographs wherein the cavitation pits are enlarged by means of a scanning electron microscope. It is recognized that a large number of cavitation holes having a size of few micrometers to 10 micrometers are formed in the surface and that the metal surface is stripped and the burrs are removed.

The preferred embodiments of a jet finishing system using the jet finishing machine(s), according to the present invention, will be described below.

Figure 3:
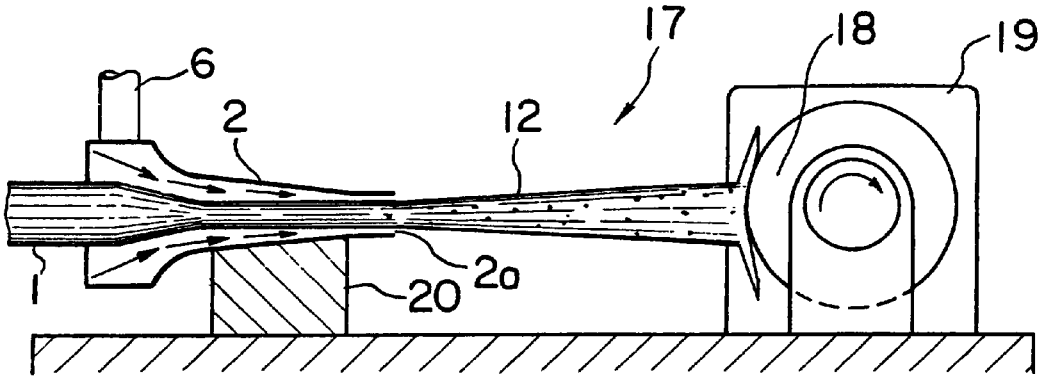
FIG. 3 is a schematic view illustrating an embodiment of a jet finishing system applied to a cylindrical work piece.

FIG. 3 shows a jet finishing system for finishing a cylindrical work piece 18, such as a metal electrode, in place of the flat plate work piece. Reference number 17 denotes the jet finishing machine shown in FIG. 1. The jet finishing machine 17 is provided on spouted-position adjusting means 20 so that the high-speed two-phase jet flow 12 is spouted at a predetermined location of the work piece 18. The spouted-position adjusting means 20 serves to adjust the longitudinal movements of the jet finishing machine 17 so as to set the work piece 18 to be spaced from the nozzle port 2*a* of the mixing nozzle 2 of the jet finishing machine 17 at an interval, and the spray angle of the high-speed two-phase jet flow 12 with respect to the surface of the work piece. In addition, the work piece 18 is driven by work-piece driving means 19 so as to scan the surface to be finished with respect to the high-speed two-phase jet flow 12. The work-piece driving means 19 serves to rotate the cylindrical work piece 18 and to move the work piece 18 in the longitudinal directions in order to uniformly finish the surface of the work piece 18.

Since this jet finishing system is provided with the spouted-position adjusting means 20, the high-speed two-phase jet flow 12 serving as a free jet flow can be spouted at an appropriate location on the surface of the cylindrical work piece 18. In addition, since the jet finishing system is provided with the work-piece driving means 19, the high-speed two-phase jet flow 12 can be uniformly spouted onto the work piece 18.

Figure 4:
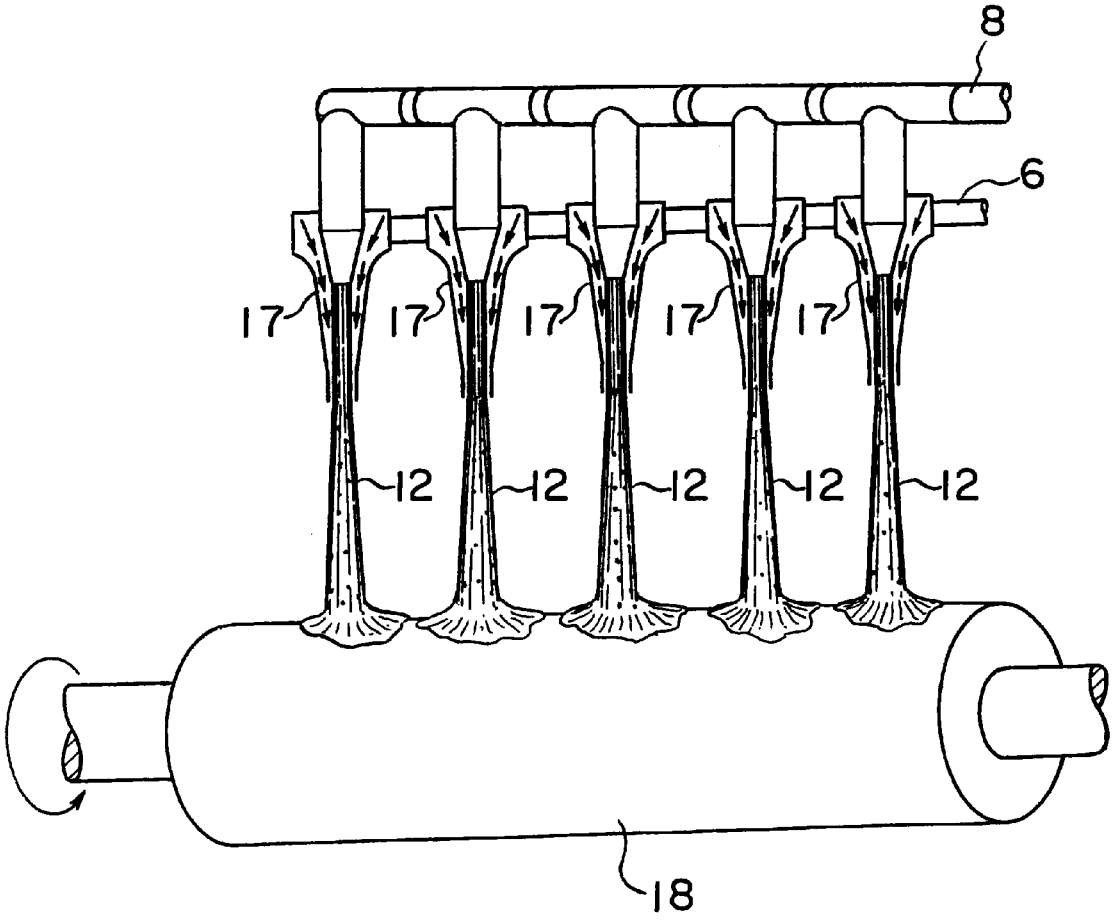
FIG. 4 is a schematic view illustrating another embodiment of a jet finishing system applied to a cylindrical work piece.

FIG. 4 shows another preferred embodiment of a jet finishing system, according to the present invention, for effectively finishing the surface of the cylindrical work piece 18. In this system, a plurality of jet finishing machines 17 are arranged in parallel to each other. To each of the jet finishing machines 17, steam is supplied via the common steam supply pipe 6, and water is supplied via the common water supply pipe 8. The work piece 18 is rotated by drive means (not shown).

Figure 5:
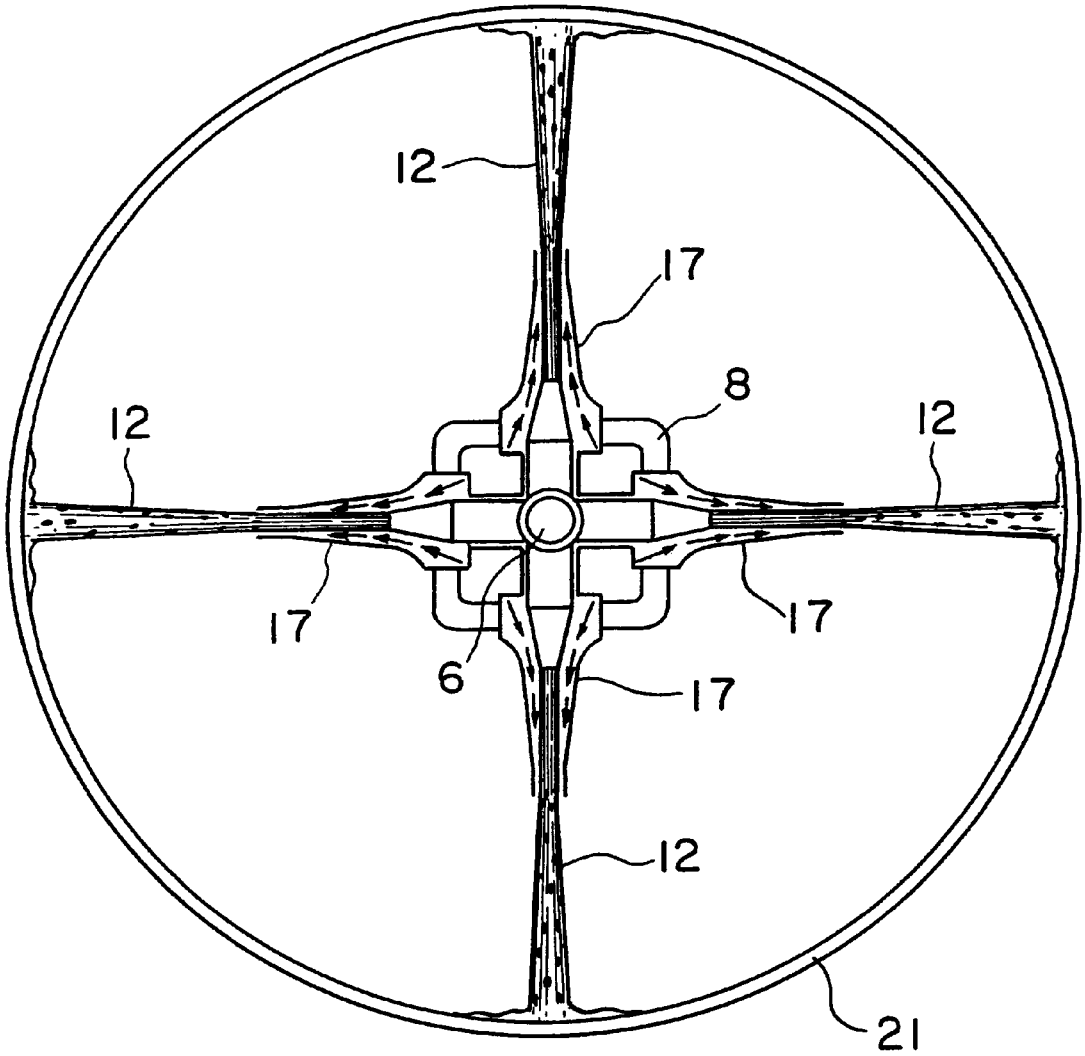
FIG. 5 is a schematic view illustrating an embodiment of a jet finishing system in which jet finishing machines are radially arranged.

FIG. 5 shows another preferred embodiment of a jet finishing system, according to the present invention, wherein a plurality of jet finishing machines 17 are radially arranged. To each of the jet finishing machines 17, steam and water are supplied via the common steam supply pipe 6 and the common water supply pipe 8, respectively. Each of the jet finishing machines 17 is arranged in a cylindrical work piece 21 such as a large-diameter piping. This system is suitable for the finishing of the inner wall of the cylindrical work piece 21 such as the large diameter piping.

Figure 6:
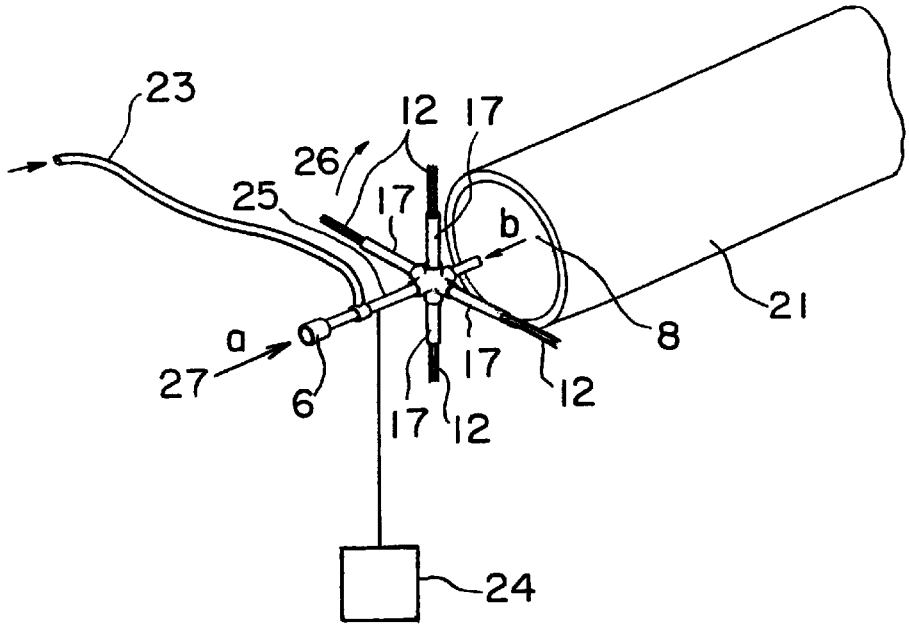
FIG. 6 is a schematic view illustrating an embodiment of a jet finishing system applied for the finishing of an inner wall of a cylindrical container.

FIG. 6 shows another preferred embodiment of a jet finishing system according to the present invention. In this system, four jet finishing machines 17 are radially connected to an axial pipe 25 so as to be spaced from each other at intervals of 45°. By axial-pipe driving means 24, the axial pipe 25, together with the four jet finishing machines 17, is rotated in circumferential directions 26 and moved in axial directions 27. To the axial pipe 25, the stream supply pipe 6 is connected in the direction of arrow a and the water supply pipe 8 is connected in the direction of arrow b. Also, a flexible pipe 23 is connected to the axial pipe 25 so as to allow the axial pipe 25 to rotate by ±45° and to move in the axial directions 17.

According to this jet finishing system, it is possible to effectively and uniformly finish the inner wall of the cylindrical work piece 21 by rotating the four jet finishing machines 17 around the axial pipe 25 by ±45° using the axial-pipe driving means 24.

Figure 7:
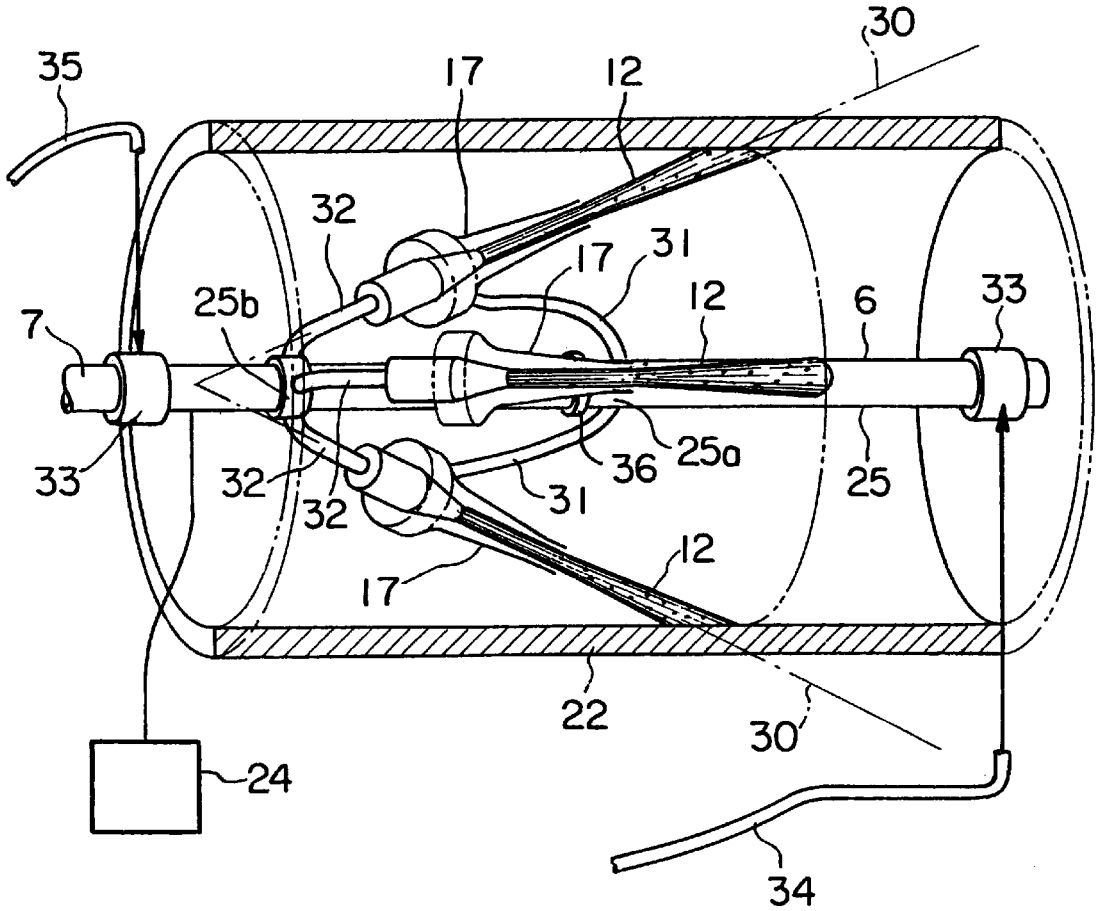
FIG. 7 is a schematic view illustrating an embodiment of a jet finishing system in which jet finishing machines are conically arranged.

FIG. 7 shows another preferred embodiment of a jet finishing system, according to the present invention, for finishing the inner wall of a small-diameter cylindrical work piece 22 such as a pipe or container of a smaller diameter than that of FIG. 6.

In this jet finishing system, a plurality of jet finishing machines 17 are connected to an axial pipe 25 serving as a rotating shaft at angular intervals. The jet finishing machines 17 are radially arranged so as to spout the high-speed two-phase jet flow 12 along an imaginary conical surface.

The axial pipe 25 is rotatably supported on a slip joint 33 and moved by axial-pipe driving means 24. The axial-pipe driving means 24 serves to control the rotation and axial movement of the axial pipe 25 integrally with the jet finishing machine 17.

Each of the jet finishing machines 17 is connected to a common stream supply pipe 6 and a common water supply pipe 8 via a stream supplying flexible pipe 31 and a water supplying flexible pipe 32, respectively. The interior of the axial pipe 25 is divided into right and left parts at the center thereof by means of a partition plate 36. The partition plate 36 is arranged between a connecting portion 25*a* of the axial pipe 25 to the stream supplying flexible pipe 31 and a connecting portion 25*b* of the axial pipe 25 to the water supplying flexible pipe 32. The right half of the axial pipe 25 on the right side of the partition plate 36 serves as the stream supply pipe 6, and the left half of the axial pipe 25 on the left side of the partition plate 36 serves as the water supply pipe 8. To the steam supply pipe 6 and the water supply pipe 7, steam and water are supplied via flexible pipes 34 and 35 connected to right and left slip joints 33, respectively. Therefore, the supply of steam and water is not obstructed by the rotation of the jet finishing machine 17 together with the axial pipe 25.

According to this jet finishing system, since the axial pipe 25 is pivotably supported on the slip joint 33, the plurality of jet finishing machines 17 conically connected to the axial pipe 25 can be rotated over an angular range of 360°. In addition, it is possible to carry out the spiral scanning finishing by simultaneously carrying out the rotation and the axial movement.

Figure 8:
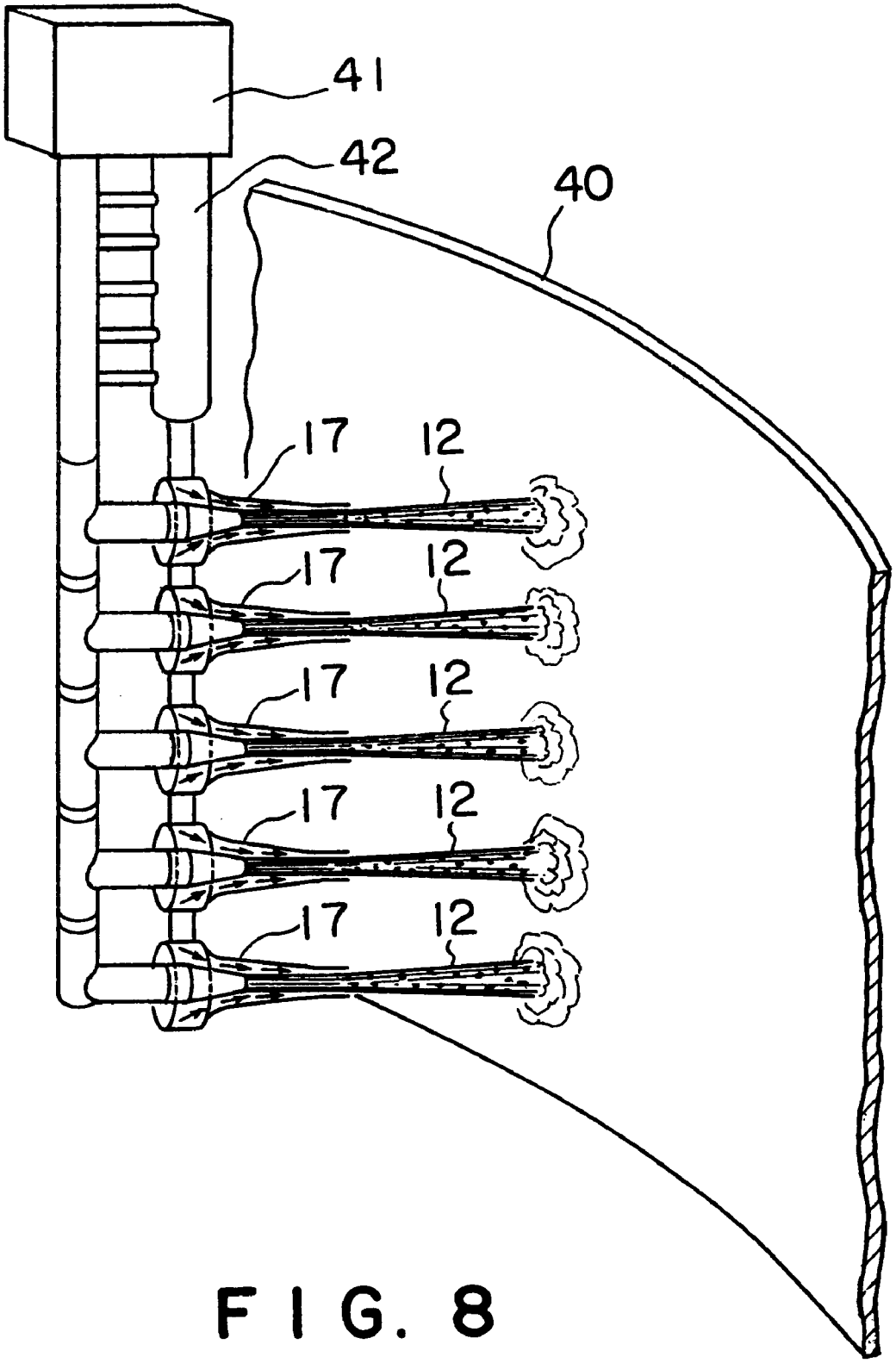
FIG. 8 is a schematic view illustrating an embodiment of a jet finishing system applied for the finishing of an inner wall of a nuclear reactor shroud.

FIG. 8 shows another preferred embodiment of a jet finishing system, to which the jet finishing machines 17 of the present invention serving as inner-wall finishing machines of a nuclear reactor shroud 40 are applied. The jet finishing machines 17 are mounted on a mast of a drive mechanism 41 such as a fuel exchange, and arranged so as to receive steam supplied from a house boiler provided in a nuclear power station. In addition, a waterproof heat insulating material 42 is provided on the outer surface of a steam piping so that the jet finishing can be carried out while being submerged.

Figure 9:
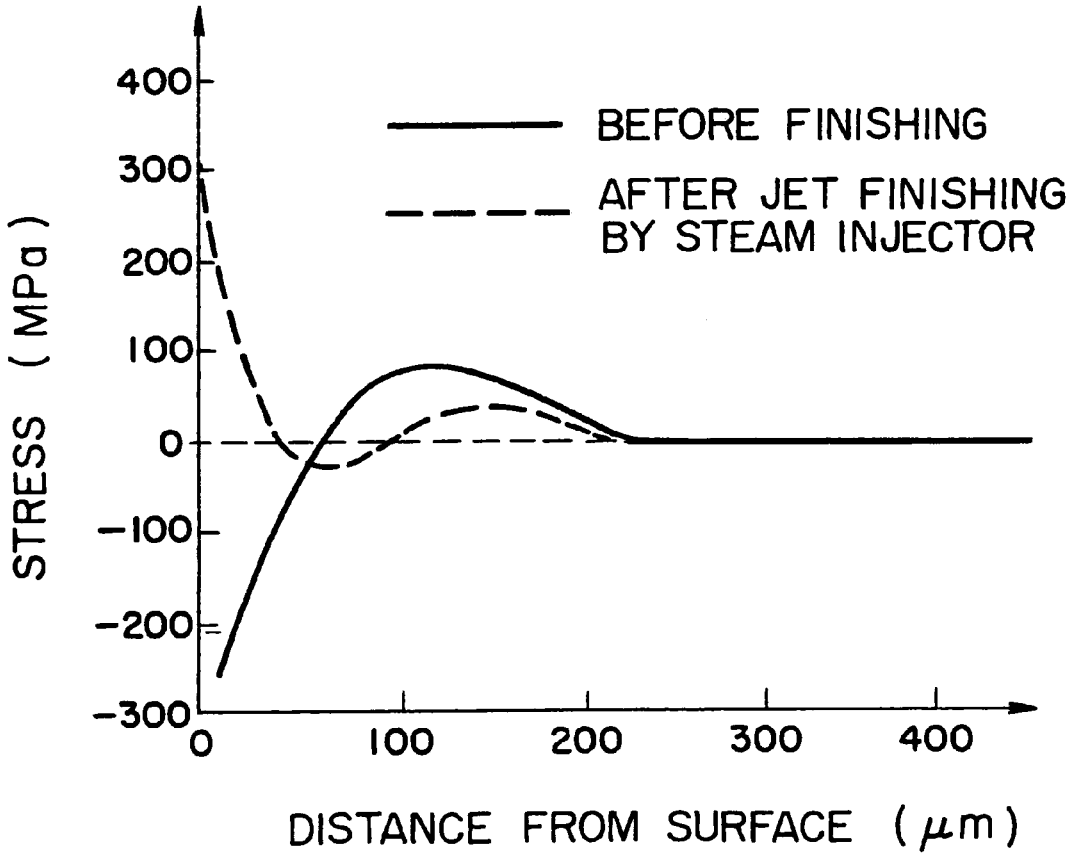
FIG. 9 is a graph showing the results when a jet finishing machine of the present invention is applied for the improvement of stress on a metal surface.

FIG. 9 is a graph showing the improved effects of the surface stress (compressive stress) of a nuclear shroud of a stainless using the jet finishing machine 17 according to the present invention. It can be seen from FIG. 9 that the surface stress was negative to easily extend cracks before the jet finishing was carried out by the high-speed two-phase jet flow 12, whereas the surface stress was positive to be compressive stress to remove the crack extending factors after the jet finishing was carried out by the high-speed two-phase jet flow 12. According to the jet finishing machine 17 of the present invention, it is possible to improve the stress on the metal surface utilizing the cavitation phenomenon due to the high-speed two-phase jet flow.

As mentioned above, the pressure of the high-speed two-phase jet flow 12 spouted from the mixing nozzle 2 is increased by the collision jet flow 13 on the surface of the work piece 5 or the like to cause cavitation, so that it is possible to remove the deposits on the metal surface and the burrs in the machining and to improve the surface stress.

Unlike the conventional steam injectors, no steam injector is used and the outlet of the mixing nozzle 2 is formed as an injection nozzle so as to form a free jet flow serving as a collision jet flow 13 between the injection nozzle and a work piece to cause a cavitation/erosion phenomenon on the surface of the work piece, so that it is possible to improve the jet finishing performance. Therefore, it is possible to carry out the jet washing using steam and water of not more than 2 MPa although a high pressure water of 30 MPa to 300 MPa is required for the conventional systems, and it is possible to provide a jet finishing machine having a simple structure and operating as an injection type steam injector.

In addition, since the jet finishing machine 17 has a simple structure, it is possible to easily provide a jet finishing system.

As mentioned above, according to the present invention, since a two-phase jet produced by mixing an excess of water jet with a steam jet with respect to the thermal equilibrium is directly spouted onto a work piece, it is possible to effectively cause a cavitation phenomenon on the surface of the work piece, and it is possible to provide a jet finishing machine and a jet finishing method which can effectively finish the work piece with a simple structure.

In addition, since the jet finishing machine has a simple structure, it is possible to easily provide a jet finishing system using the jet finishing machine(s).

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A jet finishing machine comprising:

a water nozzle portion for spouting a water jet flow of water in a liquid phase;

a steam nozzle portion for increasing the speed of a steam flow in a gas phase to a supersonic speed to produce a steam jet flow, an inner wall of said steam nozzle portion and an outer wall of said water nozzle portion being formed so as to form a converging-diverging nozzle; and a mixing nozzle portion for mixing the annulus steam jet flow condensing onto the water jet flow to accelerate the water jet flow and to form a two-phase jet flow and for directly spouting the two-phase jet flow impinging onto a work piece, said mixing nozzle portion having a tapered conical shape which is converging to a direction distal from the water nozzle portion and toward a tip of the mixing nozzle portion open to the work piece, wherein a flow passage area in a minimum cross section taken along planes perpendicular to the axis of said water nozzle portion and said steam nozzle portion is set to be greater than a value below which substantially the entire steam jet flow condenses into a liquid, and wherein a flow rate of steam flow supplied to said steam nozzle portion is greater than a flow rate below which substantially the entire steam jet flow condenses into a liquid, the flow rate of steam flow supplied to the steam nozzle portion being controlled by a steam supply nozzle connected with the steam nozzle.

2. The jet finishing machine according to claim 1, wherein said steam jet flow is mixed with said water jet flow in said mixing nozzle so that said steam jet flow is condensed and penetrates said water jet flow in the form of a plurality of small bubbles.

3. The jet finishing machine according to claim 1, wherein a tip portion of said mixing nozzle is formed with a nozzle port parallel to an axial direction of the mixing nozzle.

4. The jet finishing machine according to claim 1, wherein said water and said steam flow are produced from pure water.

5. A jet finishing method comprising the steps of:

spouting a water jet flow of water in a liquid phase;

increasing the speed of a steam flow in a gas phase to a supersonic speed and increasing a flow rate of the steam flow to be greater than a flow rate below which substantially the entire steam jet flow condenses into a liquid when mixed with the water jet flow;

mixing the steam jet flow with the water jet flow so as to allow the steam jet flow to accelerate the water jet flow to form a two-phase jet flow of the water jet flow and the steam jet flow; and directly spouting the two-phase jet flow onto a work piece.

6. A jet finishing system comprising:

a jet finishing machine comprising a water nozzle for spouting a water jet flow of water in a liquid phase, a steam nozzle for increasing the speed of a steam flow in a gas phase to a supersonic speed to produce a steam jet flow, and a mixing nozzle for mixing the steam jet flow with the water jet flow so as to allow the steam jet flow to accelerate the water jet flow to form a two-phase jet flow of the water jet flow and the steam jet flow and for directly spouting the two-phase jet flow onto a work piece; wherein a flow passage area in a minimum cross section taken along planes perpendicular to the axis of said water nozzle and said steam nozzle is set to be greater than a value below which substantially the entire steam jet flow condenses into a liquid, and wherein a flow rate of steam flow supplied to said steam nozzle is greater than a flow rate below which substantially the entire steam jet flow condenses into a liquid, the flow rate of steam flow supplied to the steam nozzle portion being controlled by a steam supply nozzle connected with the steam nozzle; and spouted position adjusting means for adjusting the position of the jet finishing machine so that the distance between a nozzle port of the mixing nozzle and a surface of the work piece is a predetermined distance.

7. A jet finishing system comprising:

a plurality of jet finishing machines arranged in a row along a rotation axis of a work piece to be rotated, each of the jet finishing machines comprising; a water nozzle for spouting a water jet flow of water in a liquid phase, a steam nozzle for spouting a water jet flow of water in a liquid phase, a steam nozzle for increasing the speed of a steam flow in a gas phase to a supersonic speed to produce a steam jet flow, and a mixing nozzle for mixing the steam jet flow with the water jet flow so as to allow the steam jet flow to accelerate the water jet flow to form a two-phase jet flow of the water jet flow and the steam jet flow and for directly spouting the two-phase jet flow onto the work piece; wherein a flow passage area in a minimum cross section taken along planes perpendicular to the axis of said water nozzle and said steam nozzle is set to be greater than a value below which substantially the entire steam jet flow condenses into a liquid, and wherein a flow rate of steam flow supplied to said steam nozzle is greater than a flow rate below which substantially the entire steam jet flow condenses into a liquid, the flow rate of steam flow supplied to the steam nozzle portion being controlled by a steam supply nozzle connected with the steam nozzle;

a steam supply pipe for supplying steam to each of said steam nozzles; and a water supply pipe for supplying water to each of said steam nozzles, said jet finishing machines being supported on said steam supply pipe or said water supply pipe.

8. A jet finishing system comprising:

a plurality of jet finishing machines, each comprising; a water nozzle for spouting a water jet flow of water in a liquid phase, a steam nozzle for increasing the speed of a steam flow in a gas phase to a supersonic speed to produce a steam jet flow, and a mixing nozzle for mixing the steam jet flow with the water jet flow so as to allow the steam jet flow to accelerate the water jet flow to form a two-phase jet flow of the water jet flow and the steam jet flow and for directly spouting the two-phase jet flow onto the work piece, said plurality of jet finishing machines being arranged radially so that said two-phase jet flow is spouted onto an inner wall of a cylindrical work piece; wherein a flow passage area in a minimum cross section taken along planes perpendicular to the axis of said water nozzle and said steam nozzle is set to be greater than a value below which substantially the entire steam jet flow condenses into a liquid, and wherein a flow rate of steam flow supplied to said steam nozzle is greater than a flow rate below which substantially the entire steam jet flow condenses into a liquid, the flow rate of steam flow supplied to the steam nozzle portion being controlled by a steam supply nozzle connected with the steam nozzle;

a steam supply pipe for supplying steam to each of said steam nozzles;

a water supply pipe for supplying water to each of said steam nozzles; and an axial pipe extending in axial directions of said cylindrical work piece for supporting thereon said jet finishing machines.

9. A jet finishing system comprising:

a plurality of jet finishing machines, each comprising a water nozzle for spouting a water jet flow of water in a liquid phase, a steam nozzle for increasing the speed of a steam flow in a gas phase to a supersonic speed to produce a steam jet flow, and a mixing nozzle for mixing the steam jet flow with the water jet flow so as to allow the steam jet flow to accelerate the water jet flow to form a two-phase jet flow of the water jet flow and the steam jet flow and for directly spouting the two-phase jet flow onto the work piece, said plurality of jet finishing machines being arranged radially so that said two-phase jet flow is spouted onto an inner wall of a cylindrical work piece; wherein a flow passage area in a minimum cross section taken along planes perpendicular to the axis of said water nozzle and said steam nozzle is set to be greater than a value below which substantially the entire steam jet flow condenses into a liquid, and wherein a flow rate of steam flow supplied to said steam nozzle is greater than a flow rate below which substantially the entire steam jet flow condenses into a liquid, the flow rate of steam flow supplied to the steam nozzle portion being controlled by a steam supply nozzle connected with the steam nozzle;

a steam supply pipe for supplying steam to each of said steam nozzles;

a water supply pipe for supplying water to each of said steam nozzles; and an axial pipe extending in axial directions of said cylindrical work piece for supporting thereon said jet finishing machines so as to allow said jet finishing machines to move in axial directions said axial pipe.

10. A jet finishing system comprising:

a plurality of jet finishing machines, each comprising a water nozzle for spouting a water jet flow of water in a liquid phase, a steam nozzle for increasing the speed of a steam flow in a gas phase to a supersonic speed to produce a steam jet flow, and a mixing nozzle for mixing the steam jet flow with the water jet flow so as to allow the steam jet flow to accelerate the water jet flow to form a two-phase jet flow of the water jet flow and the steam jet flow and for directly spouting the two-phase jet flow onto the work piece, said plurality of jet finishing machines being arranged radially so that said two-phase jet flow is spouted onto an inner wall of a cylindrical work piece; wherein a flow passage area in a minimum cross section taken along planes perpendicular to the axis of said water nozzle and said steam nozzle is set to be greater than a value below which substantially the entire steam jet flow condenses into a liquid, and wherein a flow rate of steam flow supplied to said steam nozzle is greater than a flow rate below which substantially the entire steam jet flow condenses into a liquid, the flow rate of steam flow supplied to the steam nozzle portion being controlled by a steam supply nozzle connected with the steam nozzle; a steam supply pipe for supplying steam to each of said steam nozzles;

a water supply pipe for supplying water to each of said steam nozzles; and an axial pipe extending in axial directions of said cylindrical work piece for supporting thereon said jet finishing machines so as to allow said jet finishing machines to rotate around said axial pipe.

11. A jet finishing system comprising:

a plurality of jet finishing machines, each comprising a water nozzle for spouting a water jet flow of water in a liquid phase, a steam nozzle for increasing the speed of a steam flow in a gas phase to a supersonic speed to produce a steam jet flow, and a mixing nozzle for mixing the steam jet flow with the water jet flow so as to allow the steam jet flow to accelerate the water jet flow to form a two-phase jet flow of the water jet flow and the steam jet flow and for directly spouting the two-phase jet flow onto the work piece, said plurality of jet finishing machines being arranged conically so that said two-phase jet flow is spouted onto an inner wall of a cylindrical work piece; wherein a flow passage area in a minimum cross section taken along planes perpendicular to the axis of said water nozzle and said steam nozzle is set to be greater than a value below which substantially the entire steam jet flow condenses into a liquid, and wherein a flow rate of steam flow supplied to said steam nozzle is greater than a flow rate below which substantially the entire steam jet flow condenses into a liquid, the flow rate of steam flow supplied to the steam nozzle portion being controlled by a steam supply nozzle connected with the steam nozzle;

a steam supply pipe for supplying steam to each of said steam nozzles;

a water supply pipe for supplying water to each of said steam nozzles; and an axial pipe extending in axial directions of said cylindrical work piece for supporting thereon said jet finishing machines.

12. A jet finishing system comprising:

a plurality of jet finishing machines, each comprising a water nozzle for spouting a water jet flow of water in a liquid phase, a steam nozzle for increasing the speed of a steam flow in a gas phase to a supersonic speed to produce a steam jet flow, and a mixing nozzle for mixing the steam jet flow with the water jet flow so as to allow the steam jet flow to accelerate the water jet flow to form a two-phase jet flow of the water jet flow and the steam jet flow and for directly spouting the two-phase jet flow onto the work piece, said plurality of jet finishing machines being arranged conically so that said two-phase jet flow is spouted onto an inner wall of a cylindrical work piece; wherein a flow passage area in a minimum cross section taken along planes perpendicular to the axis of said water nozzle and said steam nozzle is set to be greater than a value below which substantially the entire steam jet flow condenses into a liquid, and wherein a flow rate of steam flow supplied to said steam nozzle is greater than a flow rate below which substantially the entire steam jet flow condenses into a liquid, the flow rate of steam flow supplied to the steam nozzle portion being controlled by a steam supply nozzle connected with the steam nozzle;

a steam supply pipe for supplying steam to each of said steam nozzles;

a water supply pipe for supplying water to each of said steam nozzles; and an axial pipe extending in axial directions of said cylindrical work piece for supporting thereon said jet finishing machines so as to allow said jet finishing machines to move in axial directions said axial pipe.

13. A jet finishing system comprising:

a plurality of jet finishing machines, each comprising a water nozzle for spouting a water jet flow of water in a liquid phase, a steam nozzle for increasing the speed of a steam flow in a gas phase to a supersonic speed to produce a steam jet flow, and a mixing nozzle for mixing the steam jet flow with the water jet flow so as to allow the steam jet flow to accelerate the water jet flow to form a two-phase jet flow of the water jet flow and the steam jet flow and for directly spouting the two-phase jet flow onto the work piece, said plurality of jet finishing machines being arranged conically so that said two-phase jet flow is spouted onto an inner wall of a cylindrical work piece; wherein a flow passage area in a minimum cross section taken along planes perpendicular to the axis of said water nozzle and said steam nozzle is set to be greater than a value below which substantially the entire steam jet flow condenses into a liquid, and wherein a flow rate of steam flow supplied to said steam nozzle is greater than a flow rate below which substantially the entire steam jet flow condenses into a liquid, the flow rate of steam flow supplied to the steam nozzle portion being controlled by a steam supply nozzle connected with the steam nozzle;

a steam supply pipe for supplying steam to each of said steam nozzles;

a water supply pipe for supplying water to each of said steam nozzles; and an axial pipe extending in axial directions of said cylindrical work piece for supporting thereon said jet finishing machines so as to allow said jet finishing machines to rotate around said axial pipe.

* * * * *

UNITED STATES PATENT AND TRADEMARK OFFICE

CERTIFICATE OF CORRECTION

PATENT NO. : 6,116,858

DATED : September 12, 2000

INVENTOR(S): Tadashi NARABAYASHI

It is certified that an error appears in the above-identified patent and that said Letters Patent is hereby corrected as shown below:

On the title page, the Continued Prosecution Application information has been omitted. It should read as follows:

-- [45] Date of Patent: *September 12, 2000

[*] Notice: This patent issued on a continued prosecution application filed under 37 CFR 1.53(d), and is subject to the twenty year patent term provisions of 35 U.S.C. 154(a)(2). --

Signed and Sealed this

First Day of May, 2001

*Attest:*

Nicholas P. Godici

NICHOLAS P. GODICI

*Attesting Officer*

*Acting Director of the United States Patent and Trademark Office*